US010881223B1

(12) United States Patent
Lambert

(10) Patent No.: US 10,881,223 B1
(45) Date of Patent: Jan. 5, 2021

(54) PICTURE, TEXT, AND SUPPORT SYSTEM AND METHOD

(71) Applicant: Gary F. Lambert, Oldsmar, FL (US)

(72) Inventor: Gary F. Lambert, Oldsmar, FL (US)

( * ) Notice: Subject to any disclaimer, the term of this patent is extended or adjusted under 35 U.S.C. 154(b) by 0 days.

(21) Appl. No.: 16/924,257

(22) Filed: Jul. 9, 2020

Related U.S. Application Data

(60) Provisional application No. 62/878,399, filed on Jul. 25, 2019.

(51) Int. Cl.
*A47G 1/08* (2006.01)
*A47G 1/06* (2006.01)

(52) U.S. Cl.
CPC ..... *A47G 1/08* (2013.01); *A47G 1/0633* (2013.01)

(58) Field of Classification Search
CPC ..... A47G 61/08; A47G 1/0633; B42D 15/042
See application file for complete search history.

(56) References Cited

U.S. PATENT DOCUMENTS 3,174,244 A * 3/1965 Walton ..... B42D 15/042 40/774
4,140,317 A * 2/1979 Ramney ..... A63F 9/001 229/72
4,809,451 A * 3/1989 Suzuki ..... A47G 1/0633 40/768
5,025,579 A * 6/1991 Krueger ..... A47G 1/0627 40/769
5,074,067 A * 12/1991 Cohart ..... A47G 1/0633 40/769
5,678,339 A * 10/1997 Marventano ..... A47G 1/141 40/774
5,822,897 A * 10/1998 Ertzan ..... B42D 15/042 40/124.09
6,339,890 B1 * 1/2002 Farah ..... A47G 1/141 40/124.17
6,694,657 B2 * 2/2004 Tsao ..... A47G 1/141 229/71
7,254,912 B1 * 8/2007 Zigar ..... A47G 1/141 206/459.5
2015/0202908 A1 * 7/2015 Bundy ..... A47G 1/0633 40/725
2015/0371562 A1 * 12/2015 Feigenbaum ..... G09F 1/06 40/124.14

* cited by examiner

*Primary Examiner* — Gary C Hoge

(57) ABSTRACT

A first face has a picture with an image to be displayed. A second face is operatively coupled to the first face. The second face has text pertinent to the image on the first face. A support component is operatively coupled to the second face for positioning the picture in an orientation whereby the image is displayed with the text in operative proximity.

1 Claim, 4 Drawing Sheets

FIG. 7
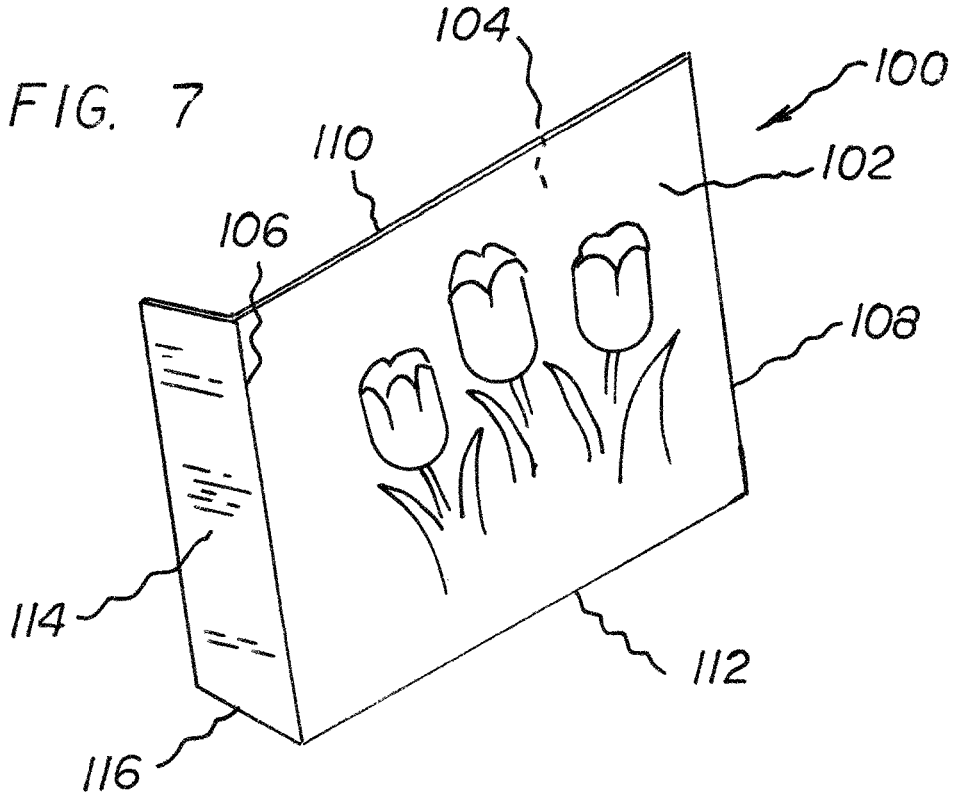
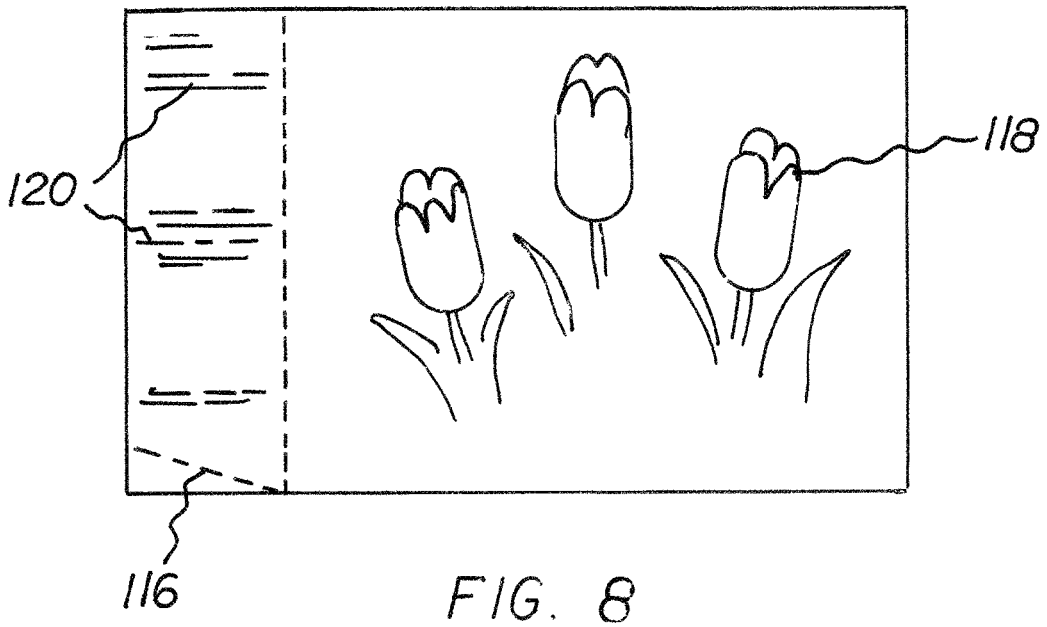
FIG. 8

PICTURE, TEXT, AND SUPPORT SYSTEM AND METHOD

CROSS-REFERENCE TO RELATED APPLICATIONS

This application claims the benefit of U.S. Provisional Application Ser. No. 62/878,399, filed Jul. 25, 2019, the entirety of which is incorporated herein by reference.

BACKGROUND OF THE INVENTION

Field of the Invention

The present invention relates to a picture, text, and support system and method and more particularly pertains to creating and displaying a picture with associated text.

Description of the Prior Art

The use of pictures is known in the prior art. More specifically, pictures previously devised and utilized for the purpose of displaying are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the aforementioned patents do not describe a picture, text, and support system and method that allows creating and displaying a picture with associated text.

In this respect, the a picture, text, and support system and method according to the present invention substantially departs from the conventional concepts and designs of the prior art, and in doing so provides an apparatus primarily developed for the purpose of creating and displaying a picture with associated text.

Therefore, it can be appreciated that there exists a continuing need for a new and improved picture, text, and support system and method which can be used for creating and displaying a picture with associated text. In this regard, the present invention substantially fulfills this need.

SUMMARY OF THE INVENTION

In view of the disadvantages inherent in the known types of pictures and displays now present in the prior art, the present invention provides an improved picture, text, and support system and method. As such, the general purpose of the present invention which will be described subsequently in greater detail, is to provide a new and improved picture, text, and support system and method which has all the advantages of the prior art and none of the disadvantages.

To attain this, the present invention essentially comprises a picture, text, and support which includes a first face having a picture with an image to be displayed. A second face is operatively coupled to the first face. The second face has text pertinent to the image on the first face. A support component is operatively coupled to the second face for positioning the picture in an orientation whereby the image is displayed with the text in operative proximity.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved picture, text, and support system and method which has all of the advantages of the prior art pictures and displays and none of the disadvantages.

It is another object of the present invention to provide a new and improved picture, text, and support system which may be easily and efficiently manufactured and marketed.

It is further object of the present invention to provide a new and improved picture, text, and support system which is of durable and reliable constructions.

An even further object of the present invention is to provide a new and improved picture, text, and support system which is susceptible of a low cost of manufacture with regard to both materials and labor, and which accordingly is then susceptible of low prices of sale to the consuming public, thereby making such a picture, text, and support system economically available to the buying public.

Even still another object of the present invention is to provide a picture, text, and support system and method for creating and displaying a picture with associated text.

Lastly, it is an object of the present invention to provide a new and improved picture, text, and support which includes a first face having a picture with an image to be displayed. A second face is operatively coupled to the first face. The second face has text pertinent to the image on the first face. A support component is operatively coupled to the second face for positioning the picture in an orientation whereby the image is displayed with the text in operative proximity.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective illustration similar to FIG. 6 but showing an alternate embodiment of the invention.

FIG. 8 is a plan view of the FIG. 7 system but with the system shown prior to folding for utilization.

The same reference numerals refer to the same parts throughout the various Figures.

DETAILED DESCRIPTION OF THE INVENTION

Figure 1:
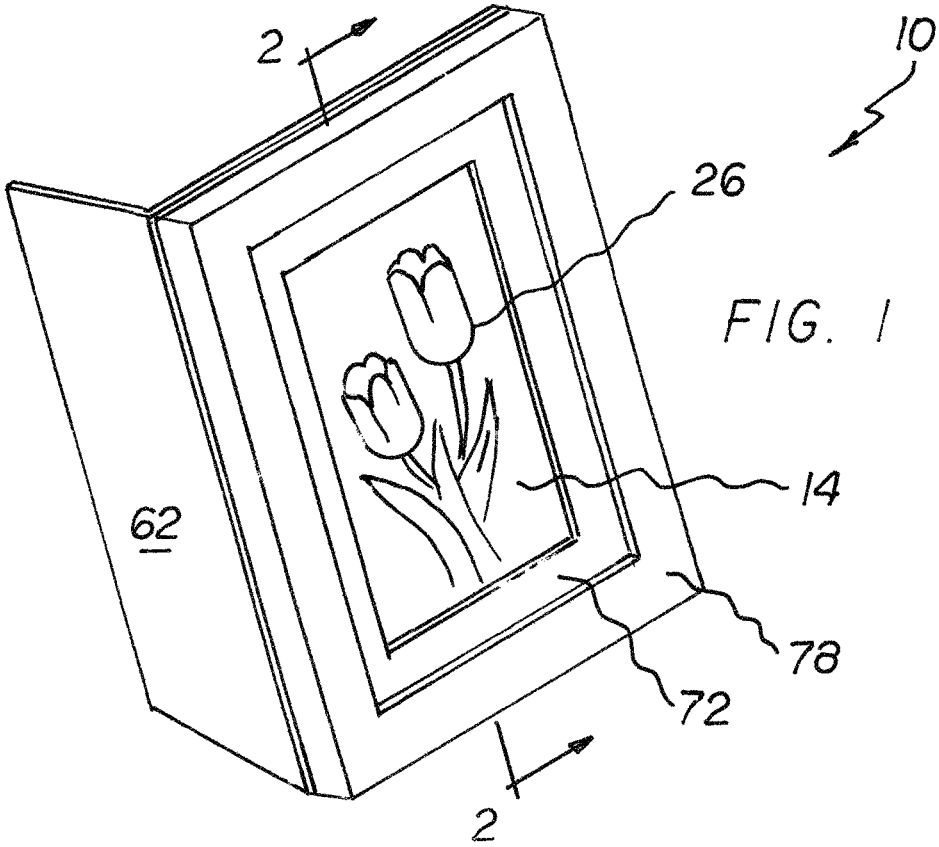
FIG. 1 is a perspective illustration of a picture and support system constructed in accordance with the principles of the present invention.
Figure 2:
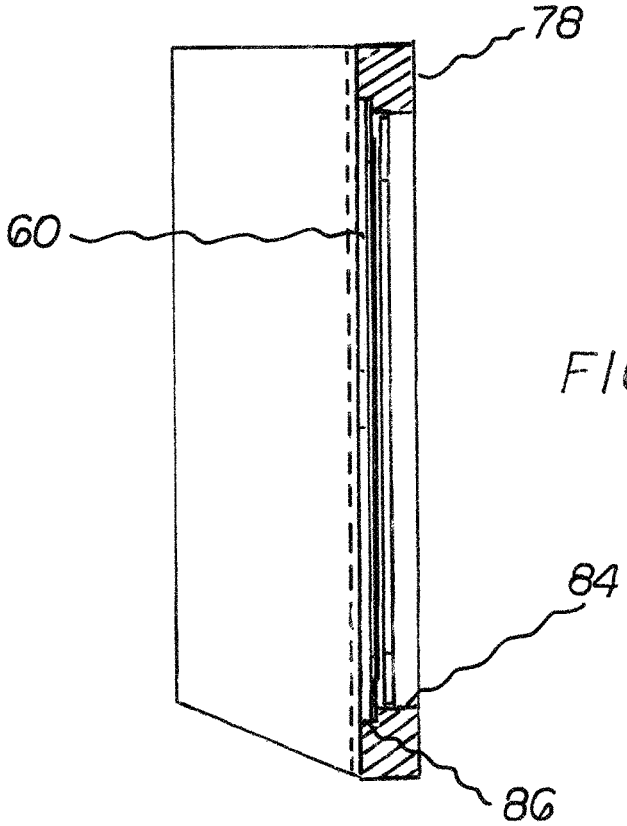
FIG. 2 is a cross sectional view taken along line 2-2 of FIG. 1.
Figure 3:
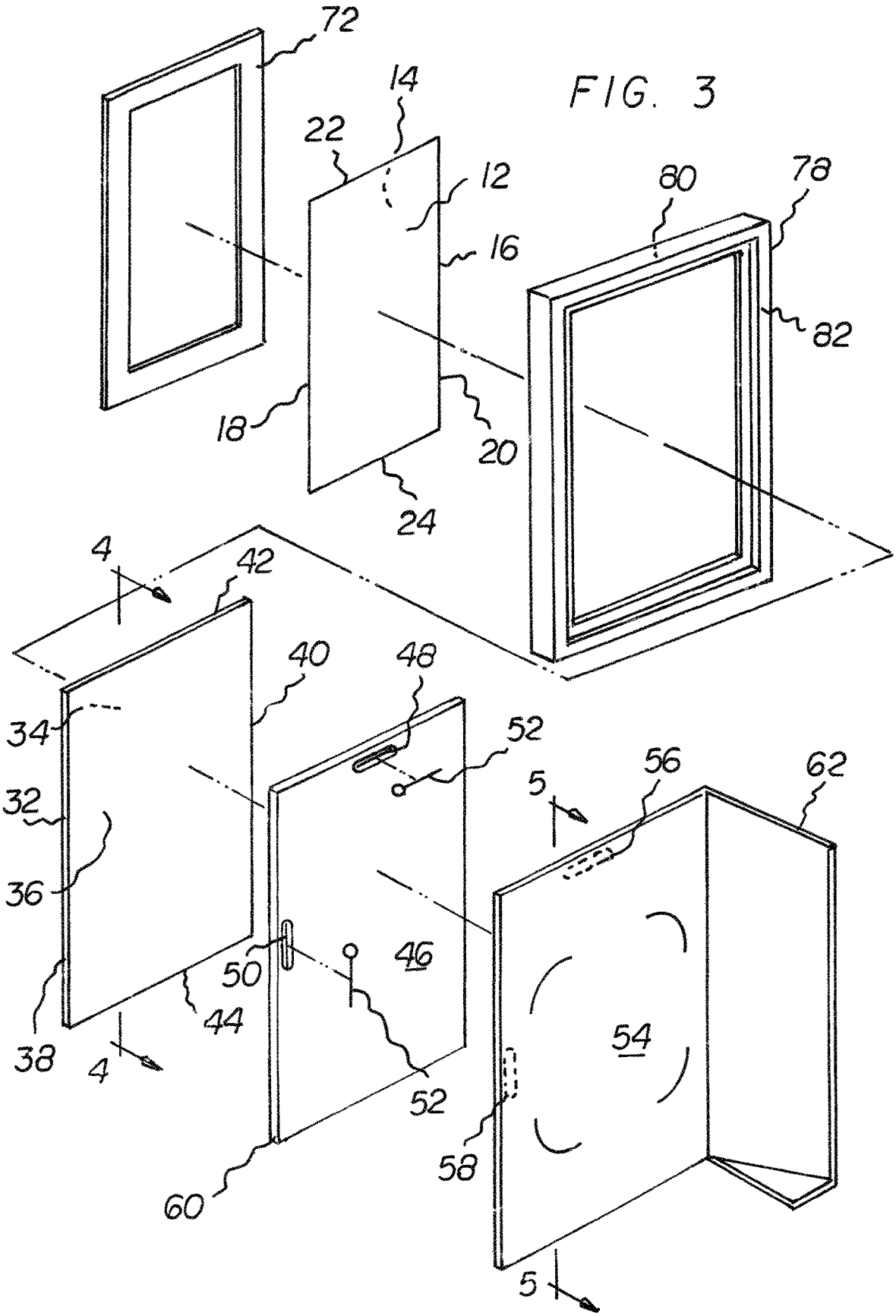
FIG. 3 is an exploded perspective view of the system shown in FIGS. 1 and 2.
Figure 4:
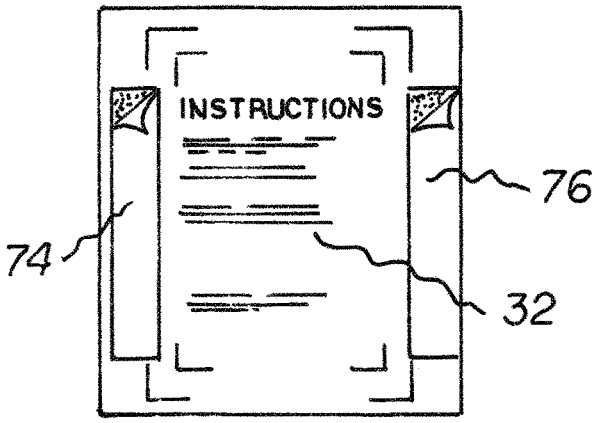
FIG. 4 is a front elevational view of the primary backing sheet.
Figure 5:
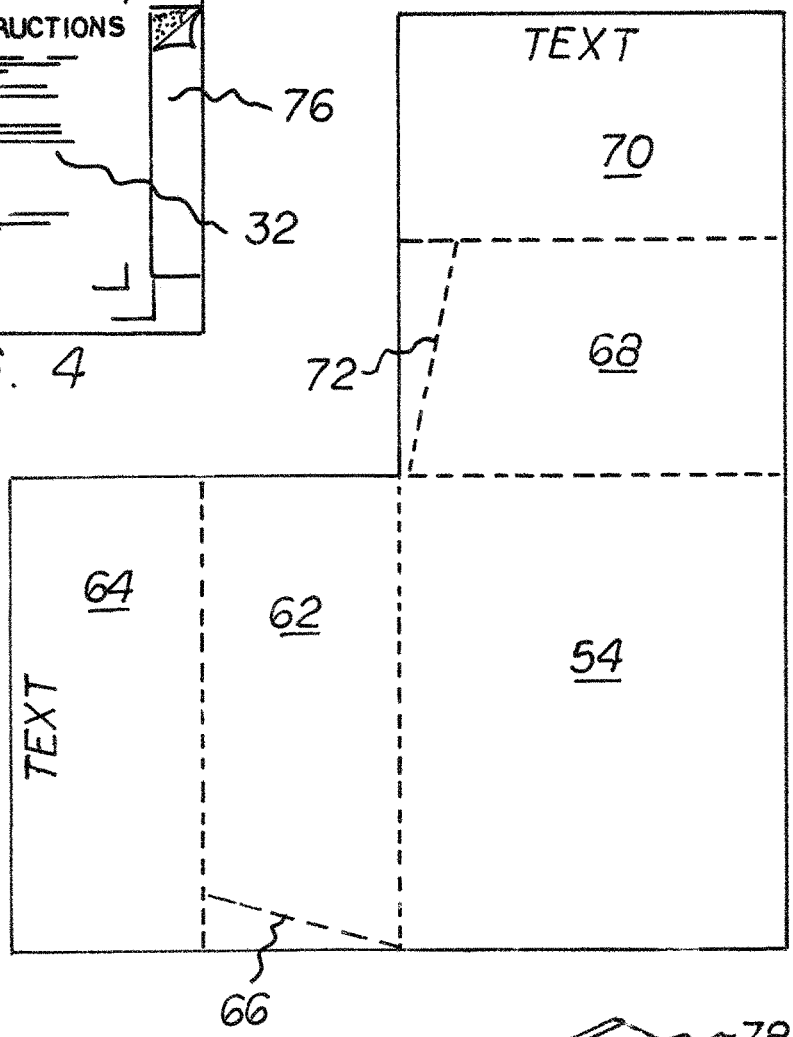
FIG. 5 is a rear elevational view of the tertiary backing sheet prior to use.
Figure 6:
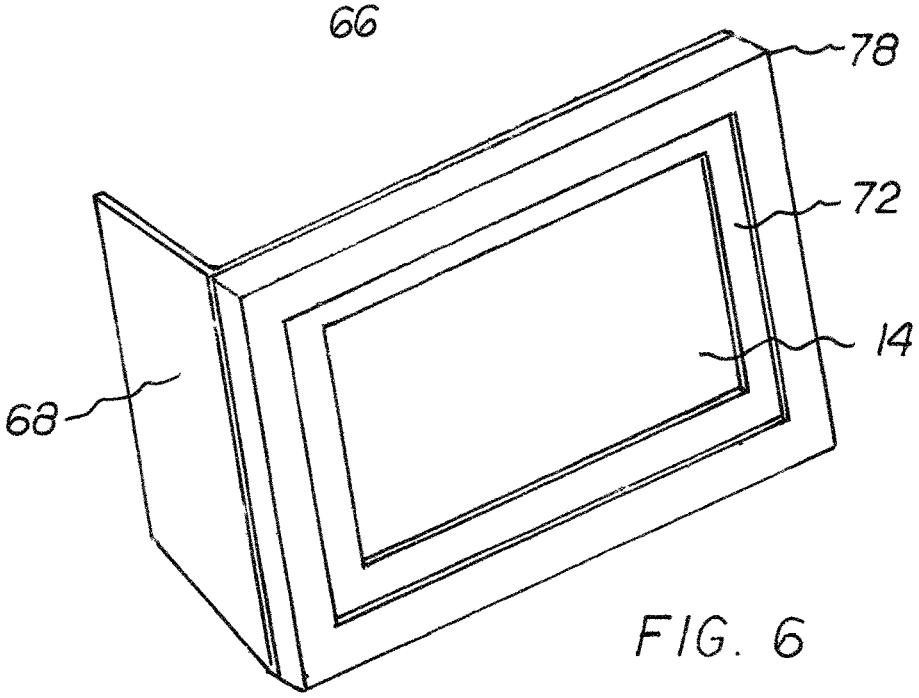
FIG. 6 is a perspective illustration of the system similar to FIG. 1 but shown in a landscape mode rather than in a portrait mode.

With reference now to the drawings, and in particular to FIG. 1 thereof, the preferred embodiment of the new and improved a picture, text, and support system and method embodying the principles and concepts of the present invention and generally designated by the reference numeral 10 will be described.

From a broad viewpoint, the present invention is a picture, text, and support system and method. A first face has a picture with an image to be displayed. A second face is operatively coupled to the first face. The second face has text pertinent to the image on the first face. A support component is operatively coupled to the second face for positioning the picture in an orientation whereby the image is displayed with the text in operative proximity. The image is chosen from a digital data bank or digitally scanned in. The text is chosen from a digital data bank or digitally key-stroked in.

More specifically, the present invention is a picture and support system. First provided is a picture 12. The picture has a front face 14. The picture has a rear face 16. The picture has a left side 18. The picture has a right side 20. The picture has a top side 22. The picture further has a bottom side 24. The front face of the picture has an image 26 to be displayed.

A rearward assembly 60 is provided. The rearward assembly is formed of a primary backing plate 32. The rearward assembly has is also formed of a secondary backing plate 46. The rearward assembly is further formed of a tertiary backing plate 54.

The primary backing plate 32 has a front face 34. The primary backing plate has a rear face 36. The primary backing plate has a left side 38. The primary backing plate has a right side 40. The primary backing plate has a top side 42. The primary backing plate further has a bottom side 44.

The secondary backing plate 46 has a front face. The secondary backing plate has a rear face. The secondary backing plate has a left side. The secondary backing plate has a right side. The secondary backing plate has a top side. The secondary backing plate further has a bottom side. The secondary backing plate is provided in facing contact with the primary backing plate. The secondary backing plate has an upper notch 48. The upper notch is provided adjacent to the top side. The secondary backing plate has a side notch 50. The side notch is provided adjacent to the left side. Also provided are pins 52. The pins facilitate hanging the system. One of the pins is removably positioned in the upper notch. Another pin is positioned in the side notch.

The tertiary backing plate 54 includes a front face. The tertiary backing plate includes a rear face. The tertiary backing plate has a left side. The tertiary backing plate has a right side. The tertiary backing plate has a top side. The tertiary backing plate has a bottom side. The tertiary backing plate is in facing contact with the secondary backing plate. The tertiary backing plate has perforations 56. The perforations overlie the notches. In this manner access is provided to the pins.

The tertiary backing plate 54 includes a side support assembly. The side support assembly has a side intermediate panel 62. The side intermediate panel has a first score line. The side intermediate panel includes a side exterior panel 64. The side exterior panel has a second score line. The second score line is provided between the side exterior panel and the side intermediate panel. The side exterior panel has an angled third score line 66. The third score line is formed beneath the side intermediate panel. In this manner the system is supported in a portrait mode.

The tertiary backing plate 54 includes an upper support assembly. The upper support assembly has an upper intermediate panel 68. The intermediate panel has a fourth score line. The upper intermediate panel has an upper exterior panel 70. The exterior panel has a fifth score line. The fifth score line is located elevationally between the upper intermediate panel and the upper exterior panel. The upper exterior panel has an angled upper sixth score line. The sixth score line is located adjacent to the upper intermediate panel. In this manner the system is supported in landscape mode.

A frame 78 is provided. The frame has a front face 80. The frame has a rear face 82. The frame has a left side. The frame has a right side. The frame has a top side. The frame further has a bottom side. The frame has an opening. The frame passes through the frame. The frame has a forward ledge 84. The opening of the frame has a rearward ledge 86. The rearward ledges receive the rearward assembly.

A mat 72 is provided. The mat has a front face. The mat has a rear face. The mat has a left side. The mat has a right side. The mat has a top side. The mat further has a bottom side. The picture and the mat are positioned in the forward ledge of the frame. The mat is a peripheral mat having an interior component of a first color and an exterior component of a second color. The peripheral mat has an opening for viewing the image. The first color and second color are representative of school/team colors of the image.

A first double faced adhesive tape 74 is provided. The first double faced adhesive tape is provided parallel with and spaced from the left edge of the primary backing plate. In this manner the primary backing plate is coupled to the picture and to the mat. A second double faced adhesive tape 76 is provided. The second double faced adhesive tape is provided parallel with and overlies the right edge of the primary backing plate. In this manner the primary backing plate is coupled to the mat. Text relating to the image is provided. The text is positioned on the side exterior panel and on the upper exterior panel. The text is adapted to be positioned on the tertiary backing plate for viewing.

The side intermediate panel 62 and the side exterior panel 64 are adapted to be separated from the tertiary backing plate 54 and discarded when in the portrait mode. The upper intermediate panel 68 and the upper exterior panel 70 are adapted to be separated from the tertiary backing plate 54 and discarded when in the landscape mode.

An alternate embodiment of the present invention is a picture and support system 100. The picture and support system has rear face 104. The picture and support system has left edge 106. The picture and support system a right edge 108. The picture a top edge 110. The picture and support system further has a bottom 112. The picture and support system has a side plate 114. The side plate is pivotably coupled to the rear face. The side plate has an angled fold line 116. The angled fold line is provided in the side plate. In this manner an edge is created to support the system.

The invention also includes the method for creating an image and an associated text and a support. The method including the steps of creating a digital data base having a plurality of images and a plurality of texts. The next step is providing a first face having an image chosen from the digital data base. The next step is providing a second face having text chosen from the digital data base, the second face having text pertinent to the image on the first face. The last step is supporting the first face and the second face components operatively coupled to the second face for positioning the picture in an orientation whereby the image is displayed with the text in operative proximity.

Such components are individually configured and correlated with respect to each other so as to attain the desired objective. As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A picture, text, and support system comprising, in combination:

a picture, the picture having a front face, and a rear face, and a left side, and a right side, and a top side, and a bottom side, the front face of the picture having an image to be displayed;

a rearward assembly, the rearward assembly including a primary backing plate, the rearward assembly also including a secondary backing plate, the rearward assembly also including a tertiary backing plate;

the primary backing plate having a front face, and a rear face, and a left side, and a right side, and a top side, and a bottom side;

the secondary backing plate having a front face, and a rear face, and a left side, and a right side, and plate has a top side, and a bottom side, the secondary backing plate being in facing contact with the primary backing plate, the secondary backing plate having an upper notch, the upper notch being located adjacent to the top side, the secondary backing plate has a side notch, the side notch being located adjacent to the left side, a plurality of pins, the pins adapted to facilitate hanging the system, a first of the pins being removably positioned in the upper notch, a second of the pins being removable positioned in the side notch;

the tertiary backing plate, the tertiary backing plate including a front face, and a rear face, and left side and a right side, and a top side and a bottom side, the tertiary backing plate being in facing contact with the secondary backing plate, the tertiary backing plate having perforations, the perforations overlie the notches whereby access is provided to the pins;

a side support assembly formed in the tertiary backing plate, the side support assembly having a side intermediate panel, the side intermediate panel having a first score line, the side intermediate panel including a side exterior panel, the side exterior panel having a second score line, the second score line being located between the side exterior panel and the side intermediate panel, the side exterior panel having an angled third score line, the third score line being located beneath the side intermediate panel whereby the system may be supported in a portrait mode; an upper support assembly formed in the tertiary backing plate, the upper support assembly including an upper intermediate panel formed with a fourth score line, the upper intermediate panel having an upper exterior panel formed with a fifth score line located elevationally between the upper intermediate panel and the upper exterior panel, the upper exterior panel formed with an angled upper sixth score line located adjacent to the upper intermediate panel whereby the system may be supported in a landscape mode;

a frame having a front face and a rear face, the frame has a left side and a right side, the frame having a top side and a bottom side, the frame having an opening passing through the frame, the opening of the frame having a forward ledge and a rearward ledge, the rearward ledges receiving the rearward assembly;

a mat having a front face and a rear face, the mat has a left side and a right side, the mat having a top side and a bottom side, the picture and the mat being positioned in the forward ledge of the frame;

a first double faced adhesive tape parallel with and spaced from the left edge of the primary backing plate whereby the primary backing plate is coupled to the picture and to the mat, a second double faced adhesive tape positioned parallel with and overlies the right edge of the primary backing plate whereby the primary backing plate is coupled to the mat;

text relating to the image, the text being positioned on the side exterior panel and on the upper exterior panel the text being positioned on the tertiary backing plate for viewing;

the side intermediate panel and the side exterior panel are adapted to be separated from the tertiary backing plate and discarded when in the portrait mode, the upper intermediate panel and the upper exterior panel adapted to be separated from the tertiary backing plate and discarded when in the landscape mode.

* * * * *